US008149205B2

(12) United States Patent
Yu et al.

(10) Patent No.: US 8,149,205 B2
(45) Date of Patent: Apr. 3, 2012

(54) CIRCUIT AND METHOD FOR DRIVING AN LCD PANEL CAPABLE OF REDUCING WATER-LIKE WAVEFORM NOISE

(75) Inventors: Chun-Lin Yu, Hsin-Chu (TW); Kuan-Yu Chen, Hsin-Chu (TW)

(73) Assignee: AU Optronics Corp., Hsin-Chu (TW)

( * ) Notice: Subject to any disclaimer, the term of this patent is extended or adjusted under 35 U.S.C. 154(b) by 891 days.

(21) Appl. No.: 11/882,957

(22) Filed: Aug. 8, 2007

(65) Prior Publication Data

US 2008/0042930 A1 Feb. 21, 2008

(30) Foreign Application Priority Data

Aug. 16, 2006 (TW) ..... 95130055 A

(51) Int. Cl.
*G09G 3/36* (2006.01)

(52) U.S. Cl. ..... 345/102

(58) Field of Classification Search ..... 345/102, 345/204, 58, 84, 87, 53
See application file for complete search history.

(56) References Cited

U.S. PATENT DOCUMENTS

| | | | | |
|---|---|---|---|---|
| 6,414,528 | B1 * | 7/2002 | Usui | 327/158 |
| 7,233,309 | B2 * | 6/2007 | Diefenbaugh et al. | 345/102 |
| 2003/0038770 | A1 * | 2/2003 | Lee et al. | 345/102 |
| 2005/0083282 | A1 * | 4/2005 | Honbo | 345/87 |
| 2007/0152951 | A1 * | 7/2007 | Ahn | 345/102 |
| 2007/0176883 | A1 * | 8/2007 | Hsu et al. | 345/102 |
| 2008/0018587 | A1 * | 1/2008 | Honbo et al. | 345/102 |

FOREIGN PATENT DOCUMENTS

| | | | |
|---|---|---|---|
| KR | 1020050070202 | A | 7/2005 |
| KR | 1020060038571 | A | 4/2006 |

* cited by examiner

*Primary Examiner* — Chanh Nguyen
*Assistant Examiner* — Pegeman Karimi
(74) *Attorney, Agent, or Firm* — Bacon & Thomas, PLLC

(57) ABSTRACT

A circuit for driving an LCD panel and a method thereof is provided. The circuit utilizes a timing controller to receive a plurality of low-voltage differential signals (LVDS) provided by an image inverter, wherein the LVDS have a horizontal synchronize signal. The timing controller, based on the horizontal synchronize signal, undergoes a modulation and transmits a plurality of lamp operation controlling signals to an inverter controlling IC, wherein the frequencies of the lamp operation controlling signals are different from one another, thereby changing the frequency of the lamp operation of the inverter controlling IC used in the LCD panel.

18 Claims, 7 Drawing Sheets

CIRCUIT AND METHOD FOR DRIVING AN LCD PANEL CAPABLE OF REDUCING WATER-LIKE WAVEFORM NOISE

The present application claims priority from Taiwan Application serial No. 095130055 filed on Aug. 16, 2006, the content of which is hereby incorporated by reference into this application.

BACKGROUND OF THE INVENTION

1. Field of the Invention

The present invention relates to a technique in the field of liquid crystal displays (LCDs), and more particularly to a circuit and a method for driving LCDs.

2. Description of Related Art

In recent years, LCD televisions have been regarded as a future star of consuming electronic products. However, when R&D personnel are doing designs on the driving circuits of the panels of LCD televisions, they are inclined to proceed with the designs by relying on their experiences on the driving circuits of LCD panels, and this results in problems.

Regarding illustrations of the driving circuits of the conventional LCD televisions, FIG. 1 is a schematic view showing a panel module for a conventional LCD television, and FIG. 2 shows a sub-pixel of a conventional display panel.

As shown in FIG. 1, the panel module includes a control board 11, a front source board 121, a rear source board 122, a gate board 13, and a display panel 14. The control board 11 includes a timing controller 111 (TCON). A plurality of source driving units 151, 152 are disposed between the display panel 14 and the front source board 121, and between the display panel 14 and the rear source board 122. Each of the source driving units 151, 152 has a source driving IC (or so-called "data IC", not shown). Further, a plurality of gate driving units 161, 162 are disposed between the display panel 14 and the gate board 13. Each of the gate driving units 161, 162 has a gate driving IC (or so-called "scan IC", not shown).

The timing controller 111 on the control board 11 is employed for outputting controlling signals to the source driving ICs and the gate driving ICs so as to enable, row by row and in sequence, the thin-film transistors (TFTs) of the display panel 14, and to charge and discharge the liquid crystal capacitances to each required gray level. For example, as shown in FIG. 2, when the Y gate line is selected, the TFTs 21, 22 electrically connected to the Y gate line will be turned on, and thereafter the $1^{st}$ to the N source driving ICs will output whole displayed data at one time (as a rule, an amplitude of an analogue voltage is revealed to show the amount of data) to the liquid crystal capacitances (Clc) 231, 232. By the storage capacitances (Cs) 241,242, the accuracy for all the data can be maintained until this gate line is selected again. When the Y+1 gate line is selected, the action mentioned above will be repeated, so that, by doing the actions in sequence, the actions to display a frame will be completed.

An example is made by a display panel complying with the wide extended graphics array+(WXGA+) and with 1366×768 resolution. Under the system signal specification defined by the National Television System(s) Committee (NTSC), 768 gate lines are required to transmit, in sequence, actuating signals during a frame time (about 16.67 ms) to turn on TFTs. In other words, every gate line can only have a share of 21.7 us (46.08 KHz). The effect of this is that during such a short period, there are a total number of 1366×3 TFTs needed to finish the actions of Turning On/Turning Off the gate, and further, the displayed data need to be written into the crystal capacitances of the source-drain. Besides, the above-mentioned short period does not include the blanking period outside the displaying area and the signal delay on the transmission lines.

It is understood that every gate line undergoes being enabled and disabled, in a very short period and with very rapid frequency. At the moment the gate line is enabled or disabled, the changing of the voltage is the most significant (about 30 to 40 volts), and then through a parasitic capacitance, Cgd, the voltage of display electrodes is affected.

The existence of the above-mentioned Cgd is similar to a common CMOS circuit wherein a parasitic capacitance is produced between the gate and the drain of a MOS. Because the gate on a display panel is connected to the outputting line of a source driving IC, in case the voltage on the source driving IC outputting line changes significantly, the voltage of the display electrodes is affected.

For example, when the gate line of a frame is enabled, an upward feed-through voltage will be produced to the displaying electrodes. However, for the sake of the enabling of the gate line at this time, the source driving IC will start to charge the display electrodes. As such, even though the voltage is not correct in the beginning due to the influence of the feed-through voltage, the source driving IC can charge the display electrodes to the correct voltage. The influence is not so large.

However, in the case where the gate line is enabled, since the source driving IC will no longer charge the display electrodes, the voltage droop (30-40 volts) produced by the disabling of the gate driving IC will feed through the displaying electrodes via the parasitic capacitance Cgd, resulting in a feed-through voltage drop on the displaying electrodes so as to affect the accuracy of the displayed grey level, and making a viewer senses the grey level discontinuity of a frame. Accordingly, in designing a driving circuit, special attention is required with respect to timing control and signal errors.

Currently, the primary issue encountered on designing display panels is the water waveform noise. When assembling an inverter of the system side to a display panel, the display frame will appear a horizontal water waveform noise. This is because in the inverter the lamp operation frequency and the horizontal synchronize (Hsync) frequency fail to synchronize with each other, and moreover, they interfere with each other, making the shared transient time for each gate line inconsistent with each other and causing a minor variation on the brightness of visual grey level.

Currently, solutions for the above-mentioned issue are:

1. Making the lamp operation frequency of the inverter as far away from the Hsync frequency as possible; and
2. Forcing the lamp operation frequency of the inverter to synchronize with the Hsync frequency so as to prevent interference from each other.

Regarding the first solution, since the two frequencies are away from each other in a limited range and besides, the Hsync frequency can be switched at the system terminal of a television, there still occurs a little water-like waveform noise. In other words, to maintain stability of the electric current of a cold cathode fluorescent lamp (CCFL), nowadays for most inverters the concept of constant current is adopted in designing a post-stage outputting circuit. Therefore, the range of the lamp operation frequency is limited by such parameters as, for example, feedback compensation value. Further, the signal standards can be switched from NTSC to Phase Alteration Line (PAL) or vice versa, so that the Hsync frequency can be varied and that the possible interference with the lamp operation frequency of the inverter is increased.

As to the second solution, using a complex programmable logic device (CPLD) is necessary so as to force the lamp operation frequency of the inverter to synchronize with the Hsync frequency. Nevertheless, such a solution not only raises the cost, but also causes a problem that there is a potential for the count of the timing clock will not be an integer during several frames.

SUMMARY OF THE INVENTION

An object of the present invention is to provide a circuit and a method for reducing water-like waveform noise in an LCD panel, so as to effectively reduce the interference between an inverter frequency and a Hsync frequency, and to soften the problem of water-like waveform noise in an LCD panel.

Another object of the present invention is to provide a circuit and a method for reducing water-like waveform noise in an LCD panel, so that by varying the inverter frequency of the LCD panel, an inverter frequency of the LCD panel can become a non-constant value.

One aspect of the present invention is to provide a circuit for reducing water-like waveform noise in an LCD panel, where the circuit comprises an image inverter, a timing controller, and an inverter controlling IC. The image inverter is used to provide a plurality of low-voltage differential signals. The timing controller is electrically connected with the image inverter and receives the low-voltage differential signals to provides a plurality of different lamp operation frequency controlling signals, respectively, according to these low-voltage differential signals. The inverter controlling IC and the timing controller are electrically connected, so that after the inverter controlling IC receives these lamp operation frequency controlling signals, the inverter controlling IC undergoes a modulation process with the lamp operation frequency controlling signals and then transmits modulated signals to a post-stage outputting circuit.

Another aspect of the present invention is to provide a method for reducing water-like waveform noise in an LCD panel, comprising the following steps: (A) to provide a plurality of different lamp operation frequency controlling signals according to an Hsync signal, where these lamp operation frequency controlling signals are transmitted, respectively, to an inverter controlling IC; and (B) proceeding a modulation process with the lamp operation frequency signals by the inverter controlling IC after the inverter controlling IC received these lamp operation frequency controlling signals to transmits modulated signals to a post-stage outputting circuit.

Still another aspect of the present invention is to provide an LCD apparatus, comprising an LCD panel, a driving circuit, an image inverter, a timing controller, and an inverter controlling IC. The LCD panel includes a top substrate, a bottom substrate, and a liquid crystal layer interposed between the top substrate and the bottom substrate. The driving circuit has a source driving unit and a gate driving unit where the source driving unit and the gate driving unit are all electrically connected to the LCD panel. The image inverter is to provide a plurality of low-voltage differential signals. The timing controller is electrically connected with the image inverter and receives the low-voltage differential signals to provide a plurality of different lamp operation frequency controlling signals, respectively, according to the low-voltage differential signals. The inverter controlling IC is electrically connected with the timing controller, so that after the inverter controlling IC has received the lamp operation frequency controlling signals, the inverter controlling IC proceeds a modulation process with the lamp operation frequency controlling signals and then transmits modulated signals to a post-stage outputting circuit.

The low-voltage differential signals include a horizontal synchronize (Hsync) signal, where the timing controller produces the lamp operation frequency controlling signals complying with processing on the Hsync signal.

The lamp operation frequency controlling signals include a lamp operation frequency controlling signal of a first frequency (i.e., a first frequency value), a lamp operation frequency controlling signal of a second frequency (i.e., a second frequency value) and a lamp operation frequency controlling signal of a third frequency (i.e., a third frequency value). The timing controller, when during a first frame, provides the lamp operation frequency controlling signal of the first frequency; and provides the lamp operation frequency controlling signal of the second frequency when during a second frame; and provides the lamp operation frequency controlling signal of the third frequency when during a third frame.

The above-mentioned timing controller provides the lamp operation frequency controlling signals to the inverter controlling IC according to a frequency controlling period, where the frequency controlling period covers several cycles, and in each cycle, the timing controller provides the lamp operation frequency controlling signals each at a different sequence.

The timing controller is electrically connected with the inverter controlling IC through a plurality of lines, where each line transmits separately a lamp operation frequency controlling signal of different frequencies.

Other objects, advantages, and novel features of the present invention will become more apparent from the following detailed description when taken in conjunction with the accompanying drawings.

DETAILED DESCRIPTION OF THE EMBODIMENTS

Figure 1:
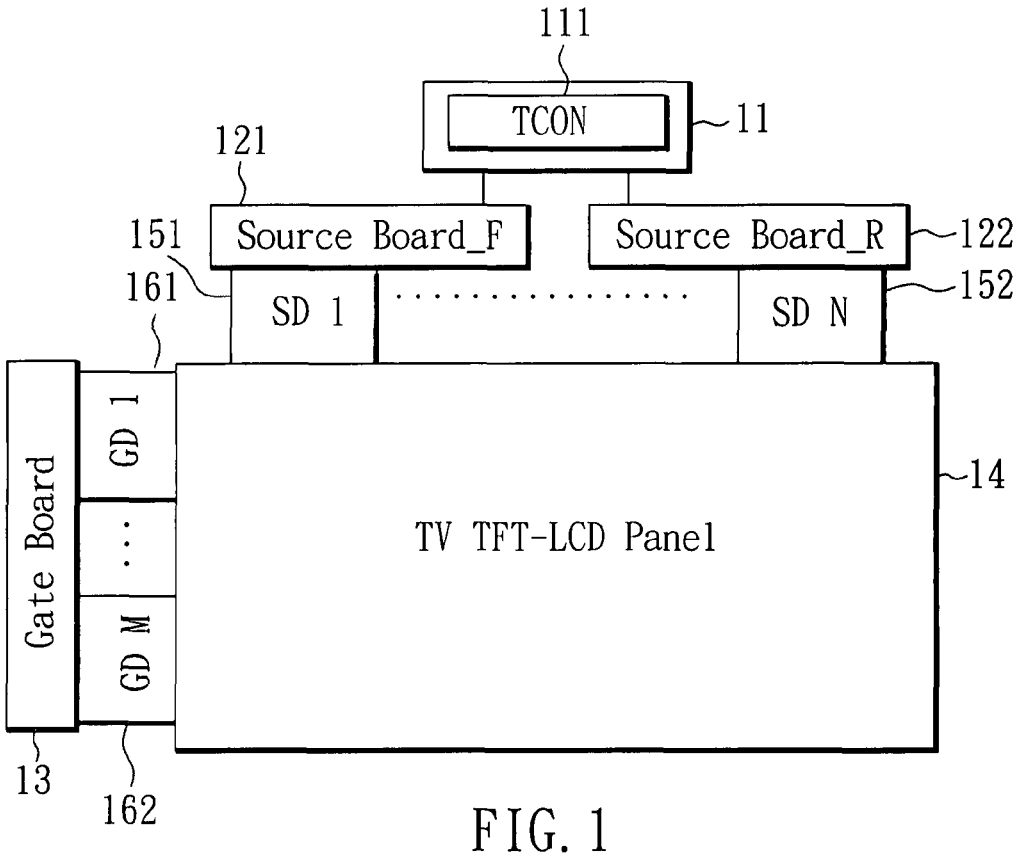
FIG. 1 (Prior Art)
FIG. 1 is a schematic view showing a panel module for a conventional LCD television.
Figure 2:
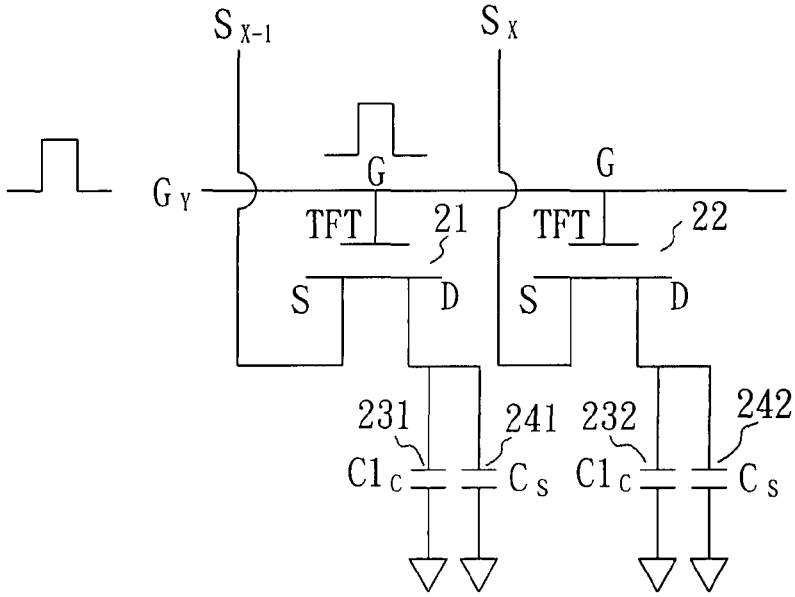
FIG. 2 (Prior Art)
FIG. 2 shows a sub-pixel of a conventional display panel.
Figure 3A:
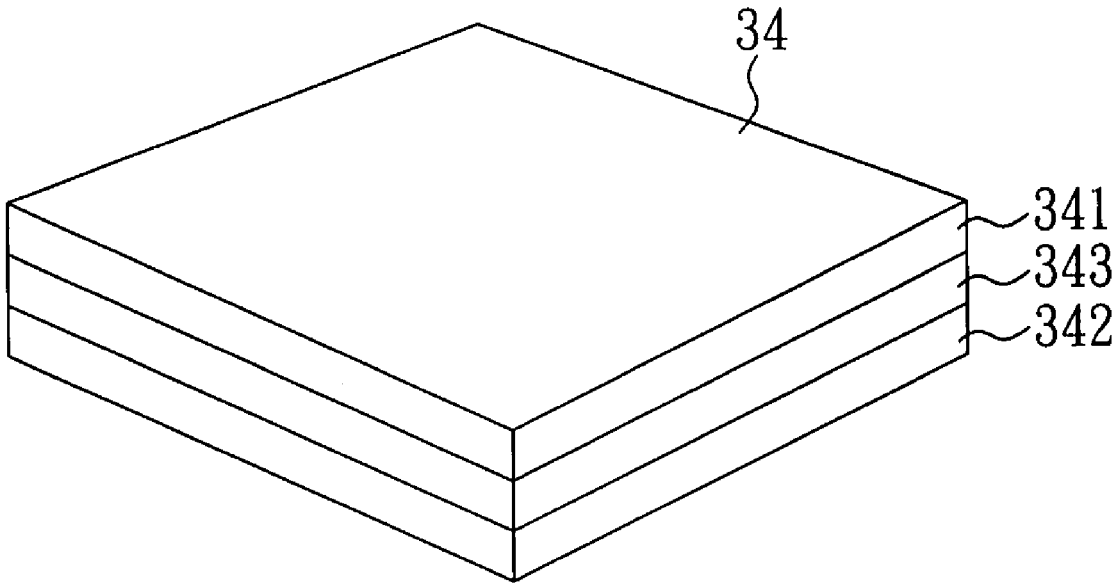
FIG. 3A is a perspective view of an LCD panel according to the present invention.
Figure 3B:
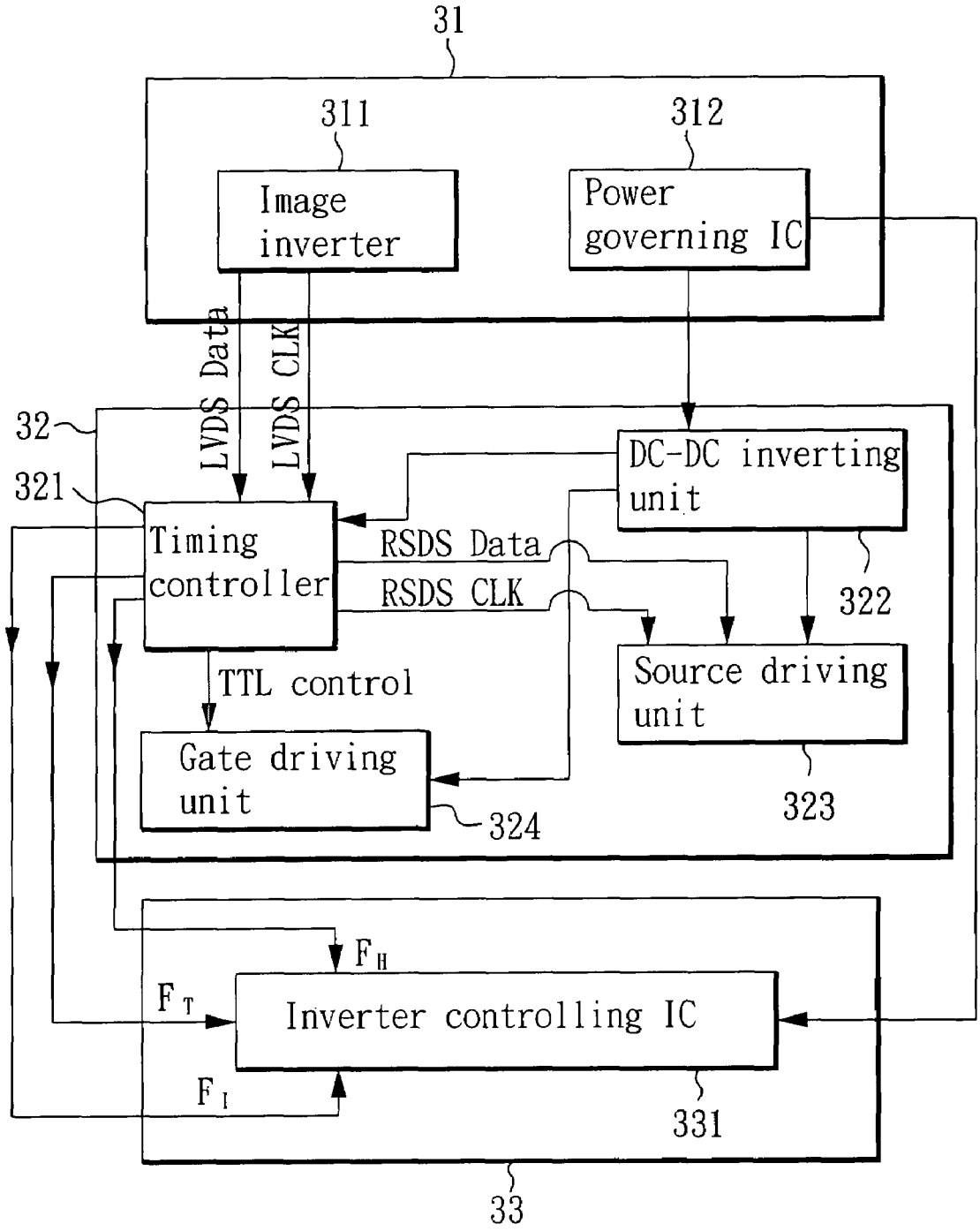
FIG. 3B is a block diagram showing the circuit for an LCD apparatus according to the present invention.

Referring to FIG. 3A, it shows a perspective view of an LCD panel according to the present invention. The LCD panel 34 comprises a top substrate 341, a bottom substrate 342, and a liquid crystal layer 343 interposed between the top substrate 341 and the bottom substrate 342. Further referring to FIG. 3B, it shows the circuit for an LCD apparatus according to the present invention, wherein the LCD apparatus comprises a system circuit 31, a driving circuit 32, and a backlight module circuit 33. The system circuit 31 further includes an image inverter 311 and a power governing IC 312; the driving circuit 32 further comprises a timing controller (TCON) 321, a DC-DC inverting unit 322, a source driving unit 323 and a gate driving unit 324; the backlight module circuit 33 further includes an inverter controlling IC 331. In the present embodiment, the source driving unit 323 comprises a plurality of source driving ICs (not shown), where the source driving unit 323 is electrically connected with the LCD panel 34 via the source driving ICs, and the gate driving unit 324 comprises a plurality of gate driving ICs (not shown) through which the gate driving unit 324 is electrically connected with the LCD panel 34.

The above-mentioned system circuit 31 is electrically connected with the driving circuit 32 and the backlight module circuit 33, respectively, and the driving circuit 32 is also electrically connected with the backlight module circuit 33. Besides, the image inverter 311 and the timing controller 321 are electrically connected, and the power governing IC 312 is electrically connected with the DC-DC inverting unit 322 and the inverter controlling IC 331. The DC-DC inverting unit 322 is electrically connected with the timing controller 321, the source driving unit 323 and the gate driving unit 324, respectively. The timing controller 321 is electrically connected with the source driving unit 323, the gate driving unit 324 and the inverter controlling IC 331, respectively. It should be noted that, in the present embodiment, the timing controller 321 is electrically connected with the inverter controlling IC 331 via three lines, so that the timing controller 321 can provide three logic designed identification signals to the inverter controlling IC 331.

The above-mentioned power governing IC 312 is to provide a system power to the driving circuit 32 and the backlight module circuit 33. The image inverter 311 is to output low-voltage differential signal (LVDS) data and low-voltage differential clock (LVDS CLK) to the timing controller 321.

The timing controller 321, after receiving the LVDS data and the LVDS CLK, undergoes a digital process on the LVDS CLK so as to output a plurality of reduced swing differential signals (RSDS) to the source driving unit 323, and output a transistor-transistor logic (TTL) controlling signal to the gate driving unit 324, wherein the reduced swing differential signals include reduced swing differential signal data and a swing differential signal timing clock.

Besides, the timing controller 321, after receiving the LVDS CLK, proceeds a modulation process via detecting the Horizontal synchronize signal (Hsync) which is restored from the compressed LVDS CLK so as to provide a plurality of lamp operation frequency controlling signals to the inverter controlling IC 331. The inverter controlling IC 331, after receiving the lamp operation frequency controlling signals, proceeds a modulation process with the lamp operation frequency controlling signals, and then transmits or outputs the modulated signals to a post-stage outputting circuit.

According to the present embodiment, the lamp operation frequency controlling signals can include signals of a first frequency $F_H$ (1, 0, 0), a second frequency $F_T$ (0, 1, 0), and a third frequency $F_L$ (0, 0, 1), so that by switching the controlling signals of above-mentioned three lamp operation frequencies, a more uniform variation in an allowed operation range can be achieved. Alternatively, in other embodiments, the timing controller 321 can provide lamp operation frequency controlling signals of more different frequencies. Taking an LCD panel having a resolution of WXGA+(1366×768) as an example, the inverter controlling IC 331 allows an operation frequency range at about 44 KHz to 52 KHz. Accordingly, the first frequency $F_H$ can be 52 KHz, the second frequency $F_T$ can be 48 KHz, and the third frequency can be 44 KHz. Likewise, other lamp operation frequency controlling signals can be divided into lamp operation frequency controlling signals of various frequencies.

Figure 4:
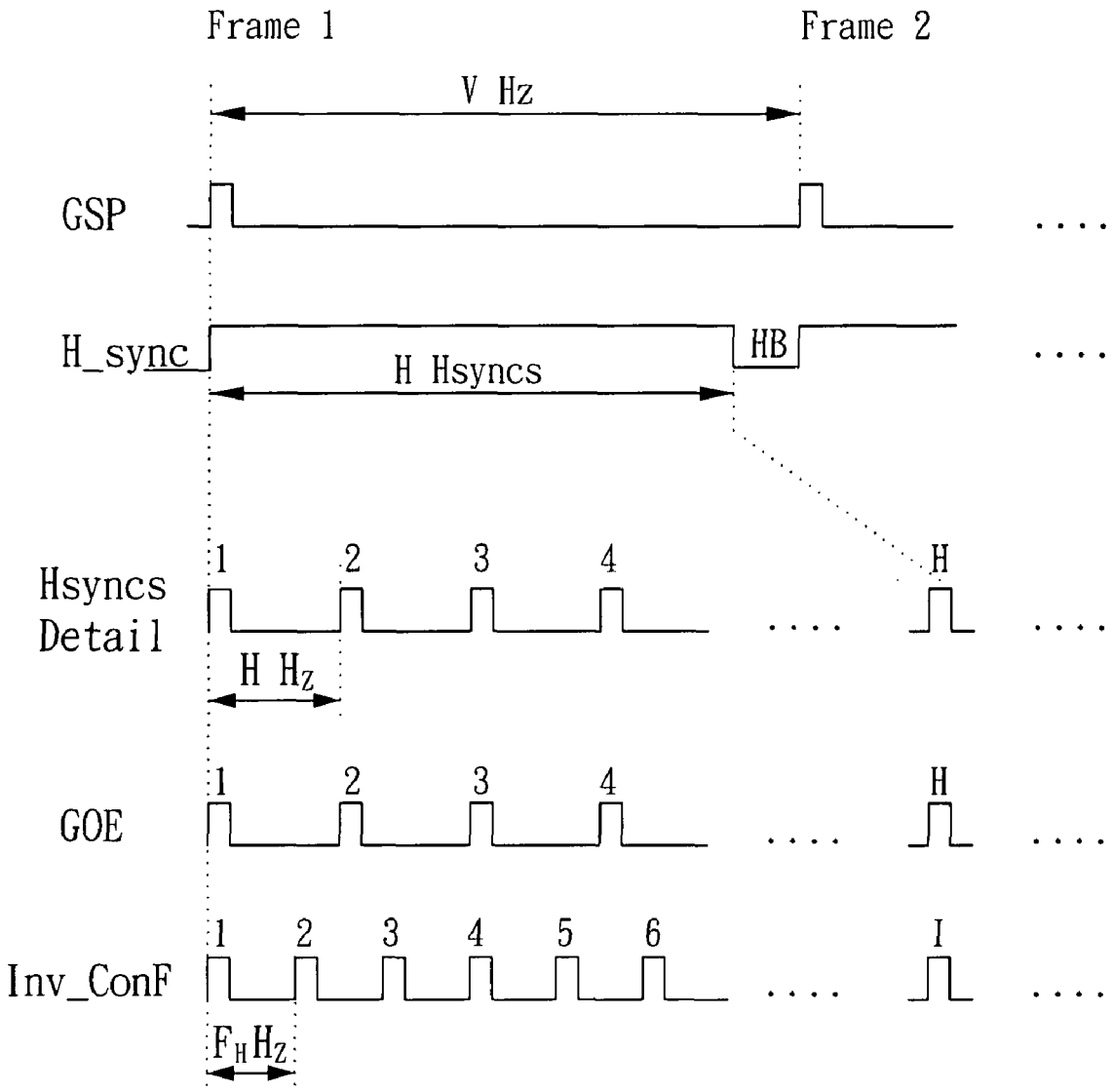
FIG. 4 is a graph showing the relationship between a first frame and the timing controller according to the present invention.

Referring to FIG. 4 (reference is made to the description for FIG. 3), a gate start pulse (GSP) refers to an initial scan signal that the timing controller 321 outputs to the gate driving unit 324, and Hsync refers to a horizontal synchronize signal sent from the image inverter 311 to the timing controller 321, wherein horizontal blanking (HB) refers to the time interval between the two frames output from the source driving ICs of the source driving unit 323, and gate output enable (GOE) refers to output shielding signals output from the timing controller 321 to the gate driving ICs of the gate driving unit 324, so as to assure two adjacent scan lines from being actuated simultaneously. The inverter control frequency ("Inv_ConF") refers to the operation frequency controlling signals output from the timing controller 321 to the inverter controlling IC 331.

As shown in FIG. 4, during the first frame, a frame rate is represented with V Hz (i.e. V number of frames scanned in every second); and the frequency of Hsync and GOE is H Hz (i.e. H number of gate lines scanned during every frame). The lamp operation frequency controlling signals (Inv_Conf) output from the timing controller 321 to the inverter controlling IC 331 are of the first frequency $F_H$ (1, 0, 0), and the timing controller 321 produces I number of pulses during the first frame.

Figure 5:
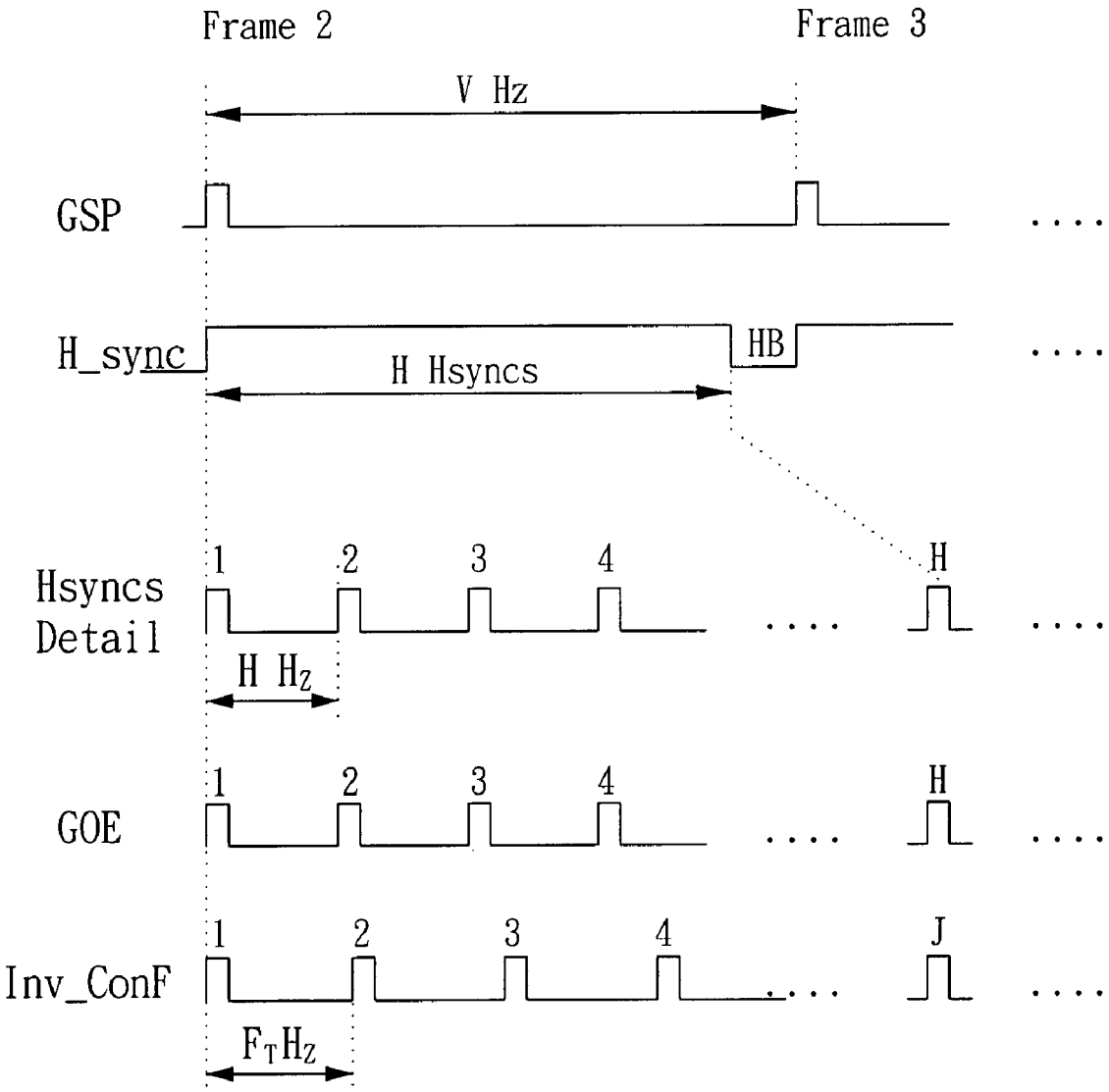
FIG. 5 is a graph showing the relationship between a second frame and the timing controller according to the present invention.

Referring to FIG. 5 (reference is also made to the description for FIG. 3), though similar to FIG. 4, the lamp operation frequency controlling signals (Inv_Conf) output from the timing controller 321 to the inverter controlling IC 331 are changed to be of the second frequency $F_T$ (0, 1, 0), and at this time, the timing controller 321 produces J number of pulses during the second frame.

Figure 6:
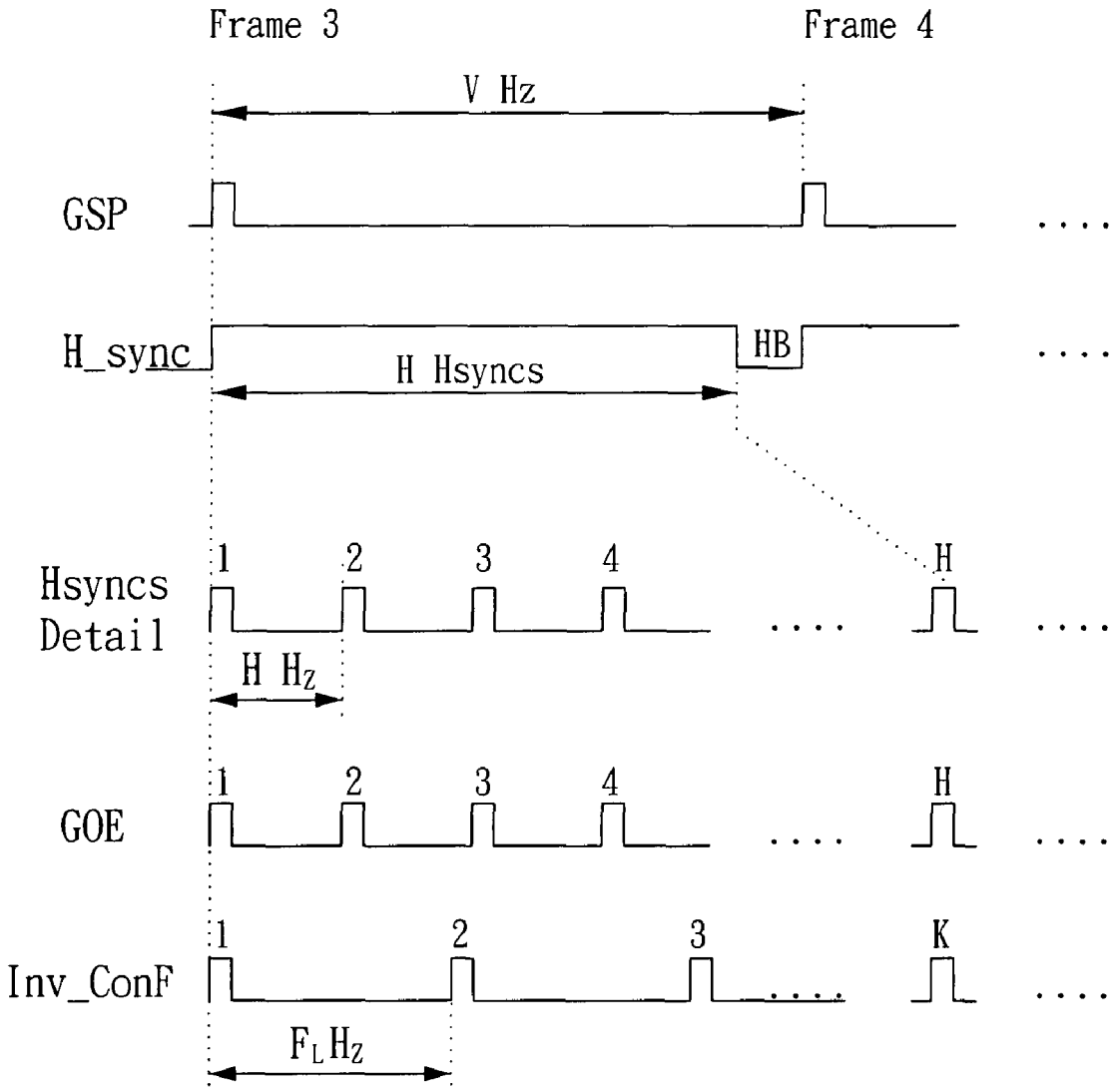
FIG. 6 is a graph showing the relationship between a third frame and the timing controller according to the present invention.

Referring to FIG. 6 (reference is also made to the description for FIG. 3), though similar to FIGS. 4 and 5, the lamp operation frequency controlling signals (Inv_Conf) output from the timing controller 321 to the inverter controlling IC 331 are changed to be of the third frequency $F_L$ (0, 0, 1), and at this time, the timing controller 321 produces K number of pulses during the third frame. From the above mention, as shown in FIGS. 4 to 6 for the three frames, it is understood that the timing controller 321 provides the invert control IC 331, respectively, with the lamp operation controlling signals of various frequencies, so as to solve effectively the issue of frequency interference between the inverter controlling IC 331 and the horizontal synchronize signal. As proposed in the present embodiment, the three frames are counted as a cycle, and therefore, the first frame, the second frame and the third frame, as shown in FIGS. 4 to 6, relate to the first cycle.

Figure 7:
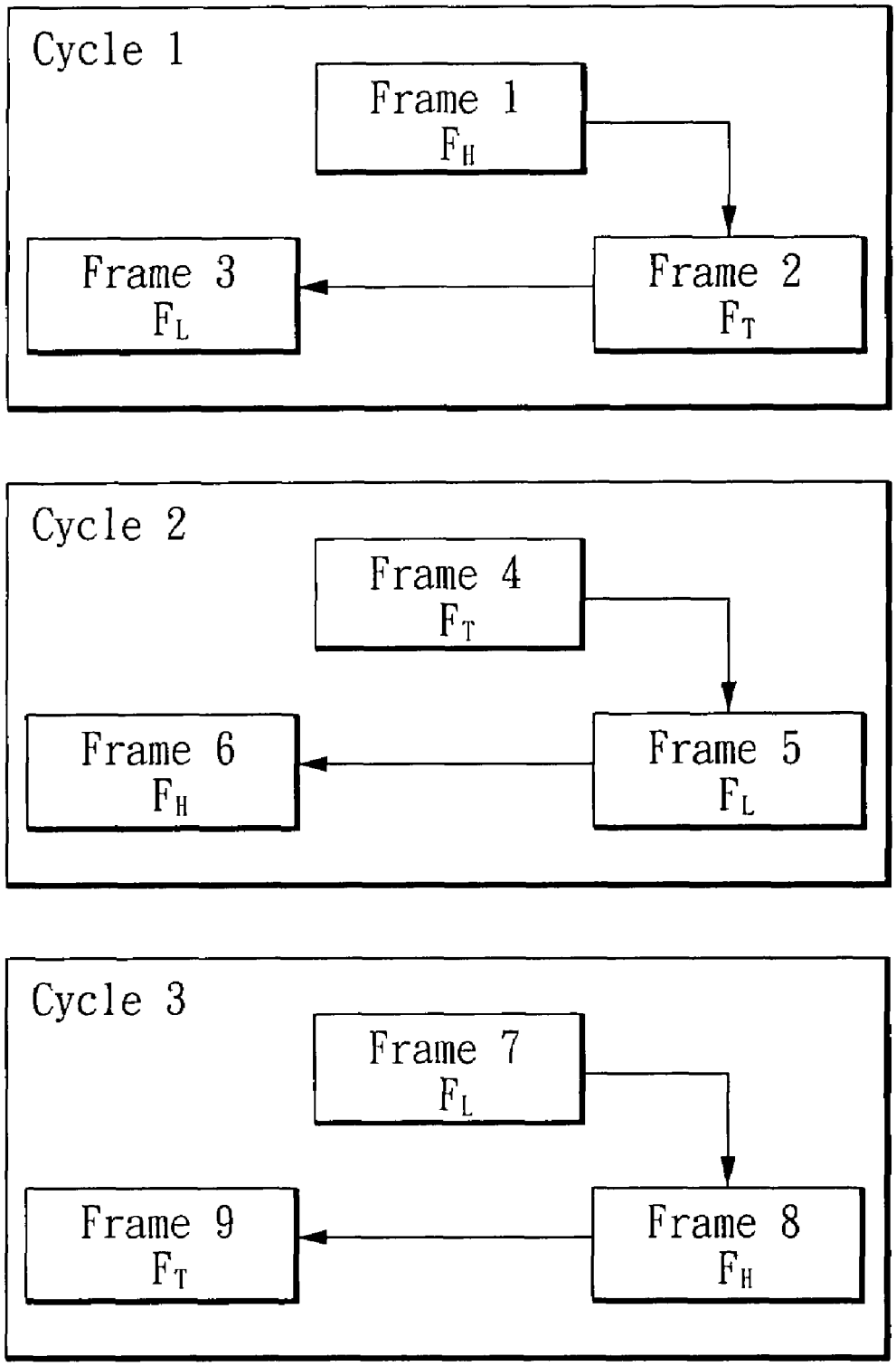
FIG. 7 is a schematic view showing a plurality of operation cycles.

In FIG. 7, there are shown the lamp operation frequency controlling signals provided from the timing controller 321 during the cycles (reference is also made to the description for FIG. 3). For example, in the first cycle, the timing controller 321 provides, during the first frame, a lamp operation frequency controlling signal of the first frequency $F_H$ to the inverter controlling IC 331; and provides, during the second frame, a lamp operation frequency controlling signal of the second frequency $F_T$ to the inverter controlling IC 331; and then provides, during the third frame, a lamp operation frequency controlling signal of the third frequency $F_L$ to the inverter controlling IC 331.

Similarly, also shown in FIG. 7, in the second cycle (from the fourth to the sixth frame) the lamp operation frequency controlling signal output from the timing controller 321 to the inverter controlling IC 331 progresses, in sequence, to another order (i.e. carry to the next digit for a digital logic signal), so that during the fourth frame, the timing controller 321 provides a lamp operation frequency controlling signal of the second frequency $F_T$ to the inverter controlling IC 331; and that during the fifth frame, the timing controller 321 provides a lamp operation frequency controlling signal of the third frequency $F_L$ to the inverter controlling IC 331; and that during the sixth frame, the timing controller 321 provides a lamp operation frequency controlling signal of the first frequency $F_H$ to the inverter controlling IC 331.

In the third cycle (from the seventh to the ninth frame) the lamp operation frequency controlling signals output from the timing controller 321 to the inverter controlling IC 331 progresses, in sequence, to yet another order (i.e. carry to the next digit for a digital logic signal), so that during the seventh frame, the timing controller 321 provides a lamp operation frequency controlling signal of the third frequency $F_L$ to the inverter controlling IC 331; and that during the eighth frame, the timing controller 321 provides a lamp operation frequency controlling signal of the first frequency $F_H$ to the inverter controlling IC 331; and that during the ninth frame, the timing controller 321 provides a lamp operation frequency controlling signal of the second frequency $F_T$ to the inverter controlling IC 331. According to the present embodiment, the timing controller 321 can form a frequency controlling period with the above-mentioned three cycles, so that the lamp operation frequency of the inverter controlling IC 331 can be maintained at a non-constant value and can be varied periodically, in sequence, within a given range of frequency and time, and that a stable output of constant current can be maintained for the CCFL.

According to the present embodiment, of course, every cycle can include more frames (e.g. four frames), and every frequency controlling period can include more cycles (e.g. four cycles).

As mentioned above, when the frame rate is V Hz, the lamp operation frequency of the inverter controlling IC 331 will be controlled, in sequence according to a rate of V/9, by the first frequency $F_H$, the second frequency $F_T$ and the third frequency $T_L$(High, Typical and Low) output from the timing controller 321. Further, the lamp operation frequency of the inverter controlling IC 331 will be varied uniformly, once for three frames; while for every nine frames the cycle repeats again. Consequently, the situation that the lamp operation frequency of the inverter controlling IC 331 can interfere with the Hsync signal is greatly reduced.

Given the above, it is understood that in the present invention, the timing controller detects the horizontal synchronize signal which is restored from compressed LVDS, and then the timing controller modulates and outputs lamp operation controlling signals of various frequencies to the inverter controlling IC, so as to vary the lamp operation frequency of the inverter controlling IC adopted in an LCD panel. In addition, by attaching resistance and capacitance on signal transmission lines, the resistive-capacitive (RC) feedback value of backlight module circuits can be adjusted, so that the lamp operation frequency of the inverter controlling IC can be a non-constant value and can be varied periodically, in sequence, within a given range of frequency and time, and that a stable output of constant current can be maintained for the CCFL, so that the water-like waveform noise resulted from an inverter of the LCD panel can thus be reduced.

Although the present invention has been explained in relation to its embodiments, it is to be understood that many other possible modifications and variations can be made without departing from the scope of the invention as hereinafter claimed.

What is claimed is:

1. A circuit for reducing water-like waveform noise in a Liquid Crystal Display LCD panel displaying a plurality of frames, comprising:

an image inverter, providing a plurality of low-voltage differential signals comprising a horizontal synchronize signal with a plurality of horizontal blankings, wherein each of the horizontal blankings corresponds to a time interval between two of the frames;

a timing controller, being electrically connected with the image inverter and receiving the low-voltage differential signals, the timing controller producing a first lamp operation frequency controlling signal with a first frequency value during all of a first frame of the frames and a second lamp operation frequency controlling signal with a second frequency value during all of a second frame of the frames after the first frame by processing the horizontal synchronize signal, wherein the first frequency value is different from the second frequency value; and an inverter controlling IC, being electrically connected with the timing controller, wherein after the inverter controlling IC receives the lamp operation frequency controlling signals, the inverter controlling IC proceeds a modulation process with the first lamp operation frequency with the first frequency value controlling signal and the second lamp operation frequency with the second frequency value controlling signal and then transmits modulated signals to a post-stage outputting circuit;

wherein the first lamp operation frequency controlling signal with the first frequency value and the second lamp operation frequency controlling signal with the second frequency value are uniformly varied and periodically cycled during every at least two different frames.

2. The circuit as claimed in claim 1, wherein the timing controller further produces a third lamp operation frequency controlling signal with a third frequency value during all of a third frame of the frames.

3. The circuit as claimed in claim 2, wherein the first frame, the second frame and the third frame are counted as a first cycle.

4. The circuit as claimed in claim 3, wherein the timing controller further provides the second lamp operation frequency controlling signal with the second frequency value during all of a fourth frame of the frames, provides the third lamp operation frequency controlling signal with the third frequency during value all of a fifth frame of the frames, and the first lamp operation frequency controlling signal with the first frequency value during all of a sixth frame of the frames, therewith the fourth frame, the fifth frame and the sixth frame being counted as a second cycle after the first cycle.

5. The circuit as claimed in claim 4, wherein the timing controller further provides the third lamp operation frequency controlling signal with the third frequency value during all of a seventh frame of the frames, provides the first lamp operation frequency controlling signal with the first frequency value during all of an eighth frame of the frames, and the second lamp operation frequency controlling signal with the second frequency value during all of a ninth frame of the frames, therewith the seventh frame, the eighth frame and the ninth frame being counted as a third cycle after the second cycle.

6. The circuit as claimed in claim 1, wherein the timing controller provides the inverter controlling IC with the first lamp operation frequency controlling signal with the first frequency value and the second lamp operation controlling signal with the second frequency value according to a frequency controlling period.

7. The circuit as claimed in claim 6, wherein the frequency controlling period comprises a plurality of cycles, and the timing controller provides the first lamp operation frequency controlling signal with the first frequency value and the second lamp operation frequency controlling signal with the second frequency value of a different sequence for each cycle.

8. The circuit as claimed in claim 7, wherein the timing controller provides the first lamp operation frequency controlling signal with the first frequency value and the second lamp operation frequency controlling signal with the second frequency value to the inverter controlling IC in each cycle, and the first lamp operation frequency controlling signal with the first frequency value and the second lamp operation frequency controlling signal with the second frequency value are of a different sequence in each cycle.

9. The circuit as claimed in claim 1, wherein the timing controller is electrically connected with the inverter controlling IC via a plurality of lines, and each line transmits, respectively, the first lamp operation frequency controlling signal with the first frequency value and the second lamp operation frequency controlling signal with the second frequency value.

10. A method for reducing water-like waveform noise in an LCD panel displaying a plurality of frames, comprising the following steps:

(A) providing a first lamp operation frequency controlling signal with a first frequency value during all of a first frame of the frames and a second lamp operation frequency controlling signal with a second frequency value during all of a second frame of the frames after the first frame by processing on a horizontal synchronize signal with a plurality of horizontal blankings each corresponding to a time interval between two of the frames, and transmitting the first lamp operation frequency controlling signal with the first frequency value and the second lamp operation frequency controlling signal with the second frequency value respectively to an inverter controlling IC, wherein the first frequency value is different from the second frequency value; and (B) proceeding a modulation process with the first lamp operation frequency controlling signal with the first frequency value and the second lamp operation frequency controlling signal with the second frequency value by the inverter controlling IC after the inverter controlling IC received the first lamp operation frequency controlling signal with the first frequency value and the second lamp operation frequency controlling signal with the second frequency value to transmit modulated signals to a post-stage outputting circuit;

wherein the first lamp operation frequency controlling signal with the first frequency value and the second lamp operation frequency controlling signal with the second frequency value are uniformly varied and periodically cycled during every at least two different frames.

11. The method as claimed in claim 10, wherein a third lamp operation frequency controlling signal with a third frequency value is further provided for all of a third frame of the frames after the second frame in the step (A).

12. The method as claimed in claim 10, wherein the first lamp operation frequency controlling signal with the first frequency value and the second lamp operation frequency controlling signal with the second frequency value are transmitted, according to a frequency controlling period, to the inverter controlling IC.

13. The method as claimed in claim 12, wherein the frequency controlling period comprises a plurality of cycles, and for each cycle, the first lamp operation frequency controlling signal with the first frequency value and the second lamp operation frequency controlling signal with the second frequency value of a different sequence is provided.

14. An LCD apparatus, comprising:

an LCD panel displaying a plurality of frames, the LCD panel including a top substrate, a bottom substrate, and a liquid crystal layer interposed between the top substrate and the bottom substrate;

a driving circuit, having a source driving unit and a gate driving unit where the source driving unit and the gate driving unit are all electrically connected to the LCD panel;

an image inverter, providing a plurality of low-voltage differential signals comprising a horizontal synchronize signal with a plurality of horizontal blankings, wherein each of the horizontal blanking corresponds to a time interval between two of the frames;

a timing controller, being electrically connected with the image inverter and receiving the low-voltage differential signals, the timing controller producing a first lamp operation frequency controlling signal with a first frequency value during all of a first frame of the frames and a second lamp operation frequency controlling signal with a second frequency value during all of a second frame of the frames by processing on the horizontal synchronize signal, wherein the first frequency value is different from the second frequency value; and an inverter controlling IC, being electrically connected with the timing controller, wherein after the inverter controlling IC receives the first lamp operation frequency controlling signal with the first frequency value and the second lamp operation frequency controlling signal with the second frequency value, the inverter controlling IC proceeds a modulation process with the first lamp operation frequency controlling signal with the first frequency value and the second lamp operation frequency controlling signal with the second frequency value and then transmits modulated signals to a post-stage outputting circuit;

wherein the first lamp operation frequency controlling signal with the first frequency value and the second lamp operation frequency controlling signal with the second frequency value are uniformly varied and periodically cycled during every at least two different frames.

15. The LCD apparatus as claimed in claim 14, wherein the timing controller further produces a third lamp operation frequency controlling signal with a third frequency value during all of a third frame of the frames.

16. The LCD apparatus as claimed in claim 14, wherein the timing controller provides the inverter controlling IC with the first lamp operation frequency controlling signal with the first frequency value and the second lamp operation frequency controlling signal with the second frequency value according to a frequency controlling period.

17. The LCD apparatus as claimed in claim 16, wherein the frequency controlling period comprises a plurality of cycles, and the timing controller provides the first lamp operation frequency controlling signal with the first frequency value and the second lamp operation frequency controlling signal with the second frequency value of a different sequence for each cycle.

18. The LCD apparatus as claimed in claim 14, wherein the timing controller is electrically connected with the inverter controlling IC via a plurality of lines, and each line transmits, respectively, the first lamp operation frequency controlling signal with the first frequency value and the second lamp operation frequency controlling signal with the second frequency value of different frequencies.

* * * * *